US006364979B1

(12) United States Patent
Grato

(10) Patent No.: US 6,364,979 B1
(45) Date of Patent: Apr. 2, 2002

(54) CARPET SEAM REPAIR TOOL

(76) Inventor: Michael C. Grato, 10212 Holden Trails Rd., Lakeside, CA (US) 92040

( * ) Notice: Subject to any disclaimer, the term of this patent is extended or adjusted under 35 U.S.C. 154(b) by 0 days.

(21) Appl. No.: 09/476,550

(22) Filed: Jan. 3, 2000

(51) Int. Cl.[7] ..... B32B 35/00

(52) U.S. Cl. ..... 156/94; 156/304.7; 29/402.18; 81/302; 81/485

(58) Field of Search ..... 156/94, 323, 304.7, 156/579; 428/62; 81/302, 485; 482/49; 16/270; 29/402.01, 402.09, 402.18

(56) References Cited

U.S. PATENT DOCUMENTS

| | | | | |
|---|---|---|---|---|
| 4,058,423 A | | 11/1977 | Bascom et al. | 156/98 |
| 4,224,726 A | | 9/1980 | Walker | 29/121.1 |
| 4,439,904 A | | 4/1984 | Hoopengardner et al. | 29/110.5 |
| 4,484,976 A | * | 11/1984 | Despins | 156/578 |
| 4,617,083 A | | 10/1986 | Yrizarris | 156/545 |
| 4,699,686 A | | 10/1987 | Franke | 156/579 |
| 4,831,905 A | * | 5/1989 | Murchison | 81/485 |
| 5,250,145 A | * | 10/1993 | Despins et al. | 156/578 |
| 5,360,385 A | * | 11/1994 | Wang | 482/49 |
| 5,543,091 A | * | 8/1996 | Conley | 264/36 |

* cited by examiner

*Primary Examiner*—Jeff H. Aftergut
*Assistant Examiner*—John T. Haran
(74) *Attorney, Agent, or Firm*—William Patrick Waters

(57) ABSTRACT

A carpet seam repair tool, and a method, for repairing a seam in installed carpet wherein a first carpet portion is separated from a second carpet portion along a seam rift and the seam overlies an adhesive tape. The repair tool includes a pair of legs joined by a pin at and end thereof for enabling coplanar movement of the legs about the pin. In use, the tool is inserted in the seam rift and a setscrew fixes the legs in a selected spaced relationship, thereby holding the carpet portions apart. The repair tool includes a wheel, rotatably attached at an end of each leg, opposite the pin. During a repair operation, the tool is drawn along the seam rift while the wheels hold the carpet portions away from the underlying tape. By holding the carpet portions away from each other, and by separating them from the tape, the repair tool enables convenient deposition of adhesive along the tape, while reducing the likelihood of getting the adhesive on the carpet portions.

14 Claims, 2 Drawing Sheets

CARPET SEAM REPAIR TOOL

BACKGROUND OF THE INVENTION

The present invention relates generally to carpeting and, more particularly, to tools for repairing defective seams in installed carpets.

Modern homes and business establishments utilize carpet as a floor covering. In many cases, the carpet is installed over a resilient pad that, in turn, covers a wood or concrete surface. The term "wall to wall" is sometimes used in reference to such installations since the carpet covers substantially all of the area between walls of a room or a hall.

In the case of a typical carpet installation, the pad is first laid onto the wood or concrete surface. The carpet, which comes in rolls having widths, typically of 12 or 15 feet, is then cut to conform to desired configuration as it overlays the pad. In some cases, because the area to be covered is wider, or indeed longer, than the carpet roll, the installer must seam the carpet. This often entails a careful cutting of carpet material and matching with similar material.

A conventional technique, when it comes to carpet seaming, is to join together two carpet portions over a strip of adhesive tape. The tape serves to hold the carpet together at the seam.

In some cases and for several reasons, joined carpet portions separate from each other and from the underlying tape. These separations often occur in areas of high foot traffic, such as the middle of a room. Repair presents several problems.

The task facing the one who is repairing the carpet, at the outset, is to salvage the carpet and restore the seam. This is often more easily said than done. In some cases, as one attempts to repair a rift in the seam, the ends open further thereby enlarging the rift. Further, repair is difficult and sometimes unsuccessful because it requires applying adhesive uniformly, within very narrow confines, without depositing adhesive on the carpet.

It is impractical for more than one person to attempt carpet seam repair. As a result, the operation becomes complicated since the one performing the repair must hold apart the two carpet portions to be joined while applying adhesive to the underlying tape.

In view of the foregoing, there has been a need for carpet repair tool that would simplify the seam repair process while enabling one person to effect the repair in a convenient and efficient manner. Desirably such a repair tool would be constructed of readily available material and low in cost. Further, it would be desirable if such a carpet repair tool was usable equally by both left and right handed individuals.

DISCLOSURE OF THE INVENTION

According to the present invention, there is provided a carpet repair tool that is conveniently and efficiently operable by left and right handed individuals. The tool enables a single individual to accomplish carpet seam repairs in an effective manner while reducing the likelihood of depositing adhesive on the carpet under repair. In addition, the repair tool of the present invention enables one to repair substantially the entire seam rift, thereby reducing the likelihood of the seam subsequently opening up again.

A preferred embodiment comprises a carpet seam repair tool, and a method, for repairing a seam in installed carpet wherein a first carpet portion is separated from a second carpet portion along a seam rift and the seam overlies an adhesive tape. The repair tool includes a pair of legs joined by a pin at an end thereof for enabling coplanar movement of the legs about the pin. In use, the tool is inserted in the seam rift and a setscrew fixes the legs in a selected spaced relationship, thereby holding the carpet portions apart. The repair tool includes a wheel, rotatably attached at an end of each leg, opposite the pin. During a repair operation, the tool is drawn along the seam rift while the wheels hold the carpet portions away from the underlying tape. By holding the carpet portions away from each other, and by separating them from the tape, the repair tool enables convenient deposition of adhesive along the tape, while reducing the likelihood of getting the adhesive on the carpet portions.

While wheels are utilized in the preferred embodiment to separate the carpet portion from the underlying tape, other techniques also have utility. Thus, for example, the wheels may be replaced by an elongated ovoid element, or a wedge shaped element, as more particularly set forth below.

While use of the repair tool is described with respect to carpet seam defects in carpet installed over a pad, the invention is equally useful in cases of seam rifts where the carpet is adhered directly to a floor.

Other aspects and advantages of the present invention will become apparent from the following detailed description, taken in conjunction with the accompanying drawings, illustrating by way of example the principles of the invention.

BEST MODE FOR CARRYING OUT THE INVENTION

Figure 1:
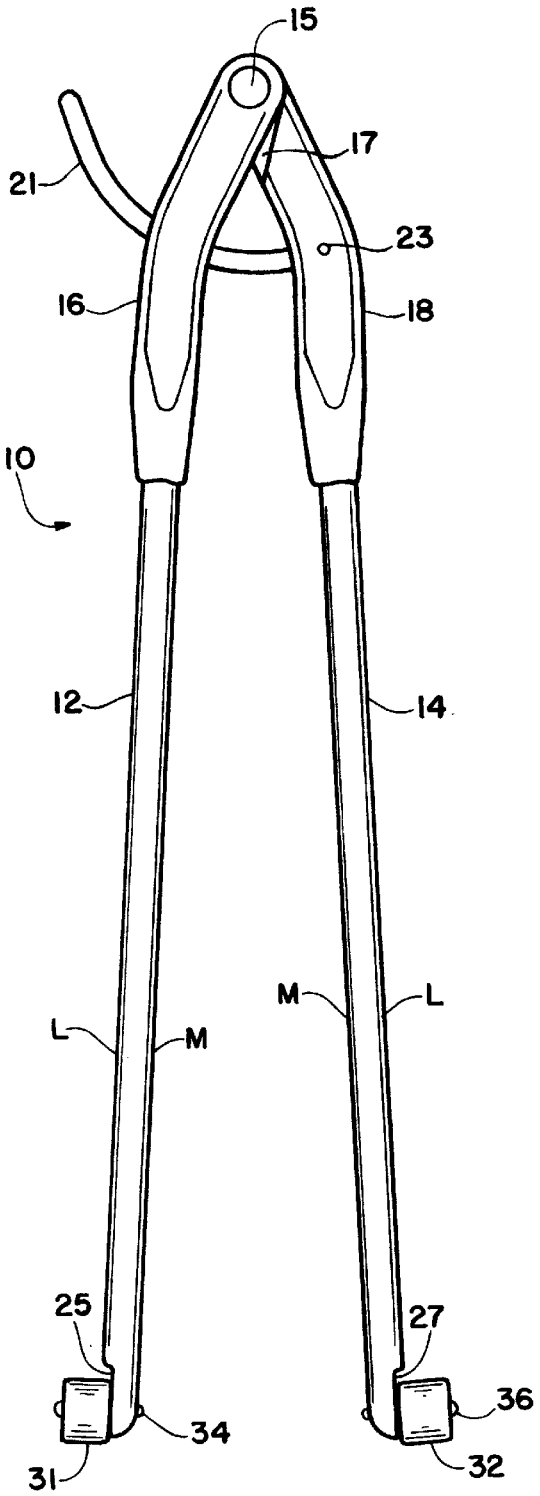
FIG. 1 is an isometric view of a carpet repair tool that is constructed according to the present invention.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes, which come within the meaning and range of equivalency of the claims, are to be embraced within their scope.

In the following detailed description and in the several figures of the drawings, like elements are identified with like reference numerals.

Figure 3:
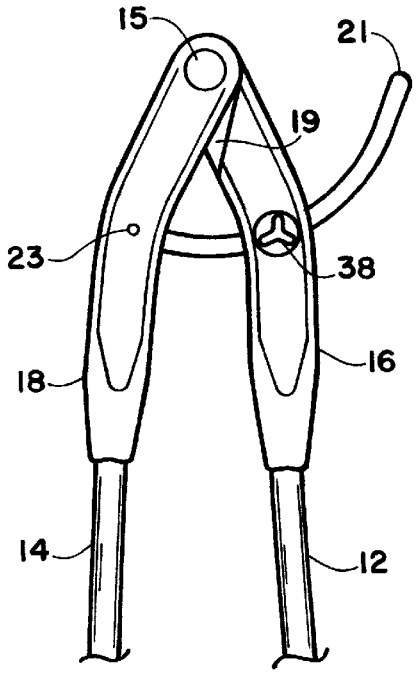
FIG. 3 is an isometric view of the carpet repair tool of FIG. 1 showing the reverse side of a portion thereof.
Figure 4:
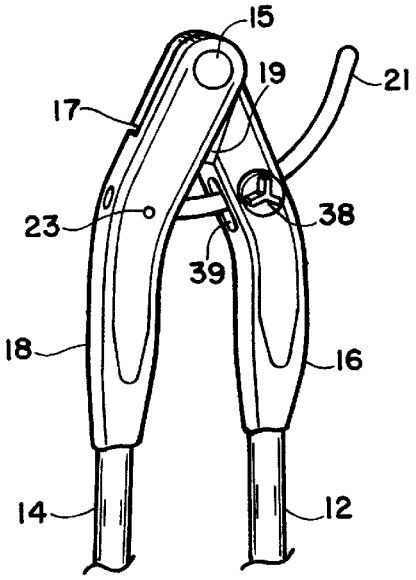
FIG. 4 is a perspective view of the portion of the carpet repair tool shown in FIG. 3.

Referring now to the drawings, and in particular to FIGS. 1, 3 and 4 thereof, there is shown a carpet repair tool 10 that is constructed according to the present invention. The tool 10 may be constructed of a variety of hard plastics or metals while, in a preferred embodiment, aluminum is the material of choice. The carpet repair tool 10 includes two straight and similar legs 12 and 14. The legs 12 and 14 are generally cylindrical throughout a substantial portion of their length. For convenience of description, each one of the legs 12 and 14 shall be described as having an upper portion 16 and a lower portion 18, respectively. The upper portions 16 and 18 each include, respectively, flattened portions 19 and 17. The portions 19 and 17 are joined at an upper end thereof by a pin 15 for rotational movement thereabout of the legs 12 and 14.

A curved guide 21, fixed at a pin 23 to the leg 14, extends through an opening 39 in the leg 12. During use of the repair tool 10, the user inserts the tool between carpet portions, to hold them in a separated condition, by moving the legs 12 and 14 apart. In this regard, the guide 21 helps the legs to move in a coplanar manner. After a desired amount of separation is achieved, the user is able to fix the legs by means of a captive set screw 38 which extends through the leg 12 to engage the leg 14 and hold the legs, in a conventional manner, in a spaced relationship.

While each leg 12 and 14 is cylindrical in a substantial portion of its length, the lower portion of each leg may be regarded as having a medial surface M and a lateral surface L, as shown in FIG. 1. Flat regions, or lands 25 and 27, are formed at the lower ends, respectively, of the legs 12 and 14. Pins 34 and 36 attach wheels 31 and 32, respectively, to the lands 25 and 27 respectively.

Figure 2:
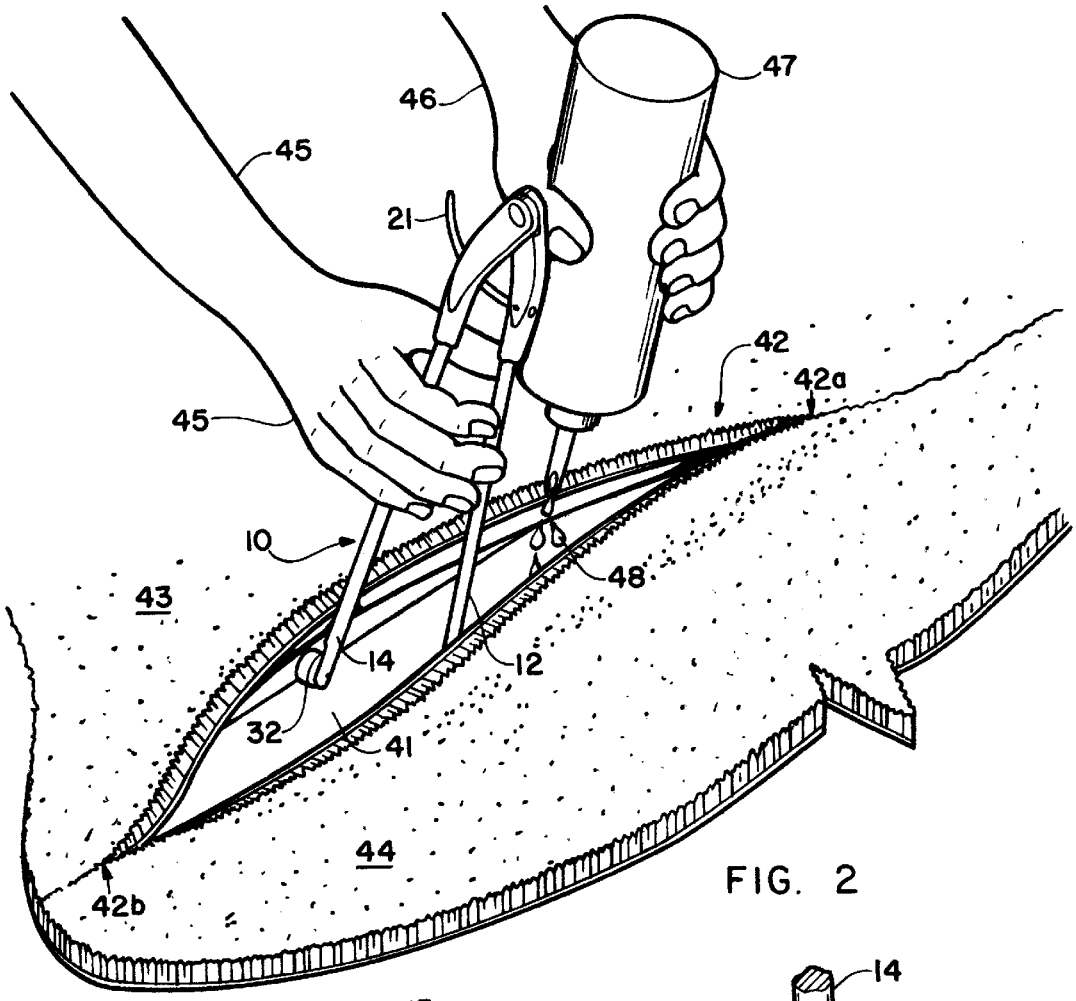
FIG. 2 is an illustrative view of the carpet repair tool of the present invention shown as used in the repair of a rift in a carpet seam.

With reference now to FIG. 2, there is shown a technique of using the carpet repair tool 10. Carpet portions 43 and 44 are joined at a seam 42. The seam 42 overlies a tape 41 and, because of such conditions as moisture, traffic or an original defective job of installation, the seam parts at a rift, defined by a first location 42*a* and a second location 42*b*.

The challenge, frequently unmet, facing one attempting repair is to distribute adhesive uniformly over the entire length of the rift. Any failure in such distribution only leaves one or more regions along the seam 42 where future rifts may occur. The task is difficult since the carpet portions 43 and 44 were cut originally to abut tightly against one another. This makes adhesive distribution very difficult, especially at the first location 42*a*, and second location 42*b*, where there is little room to move. In conventional techniques, one attempting repair must separate the carpet portions 43 and 44 and, while holding them apart, apply adhesive uniformly from a glue gun or tube. Compounding the challenge is the fact that deposition of adhesive on the upper surfaces of the carpet portions 43 and 44 should be avoided.

The carpet repair tool 10 has utility in resolving the aforesaid problems. In use, the tool is inserted into the seam rift, near the first location 42*a*. While grasping the tool in a hand 45, the user rotates the tool 10 and separates the legs 12 and 14 until the wheels 31 and 32 are each disposed between the tape 41 and the carpet portions 43 and 44. The legs 12 and 14 can be fixed in the spaced condition by means of the see screw 38.

With the repair tool 10 properly adjusted, the user draws the tool along the rift, from the first location toward the second location. This can be readily accomplished by right or left handed users by a hand 45 while the other hand 47 grasps an adhesive dispenser 47 for deposition of adhesive droplets 48 onto the tape 41. In this manner, a uniform deposition of adhesive onto the tape 41 is accomplished with little danger of getting adhesive onto the carpet. After the adhesive has been deposited and the tool 10 has been drawn close to the second location 42*b*, the setscrew 38 is backed off and the legs 12 and 14 are drawn together. The tool 10 can then be rotated to disengage the wheels 31 and 32 from their position between pad and carpet. After such disengagement, the tool 10 is lifted away from the seam.

Figure 5:
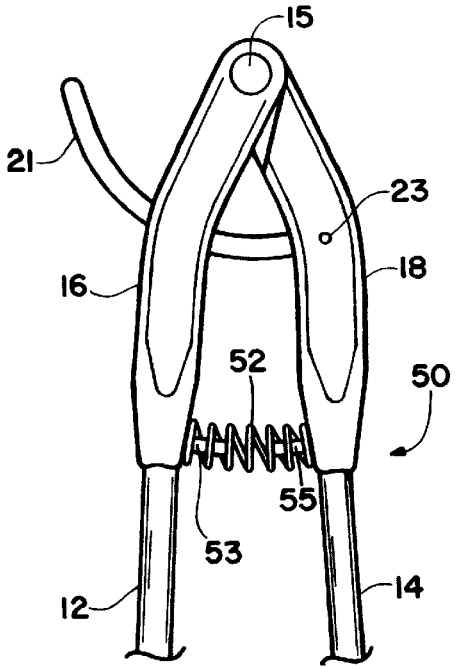
FIG. 5 is an isometric view of a portion of another embodiment of the carpet repair tool.

An embodiment 50 of the invention, having certain additional features, is shown in FIG. 5. This embodiment is similar to that shown in FIG. 1, and for convenience, components in FIG. 5 that are similar to components in FIG. 1 are assigned the same reference numerals while different components are assigned different reference numerals.

Instead of the setscrew 38 for fixing the legs 12 and 14, the tool 50 includes a spring 52 disposed between the legs 12 and 14. During use, the spring 52 tends to hold the legs apart, thereby enabling the user to hold the tool 50 at a suitable leg separation during the repair process. Stops 53 and 55 serve to protect the hand of the user by limiting the extent to which the legs 12 and 14 can be squeezed together.

Figure 6:
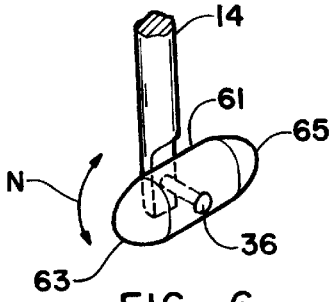
FIG. 6 is an isometric view of a portion of the carpet repair tool of FIG. 1 showing an embodiment thereof in which a wheel is replaced by an elongated ovoid element.

Referring now to FIG. 6, there is shown another technique for practicing the present invention. Here, the wheels, such as the wheel 32, are replaced by an elongated ovoid element 61, shown attached by the pin 36 to the leg 14. The element 61 is free to move up or down as indicated by the double arrow N and it includes generally rounded, bullet shaped ends 63 and 65. In use, the ovoid element slides between the carpet portions 43 and 44 and the tape 41.

Figure 7:
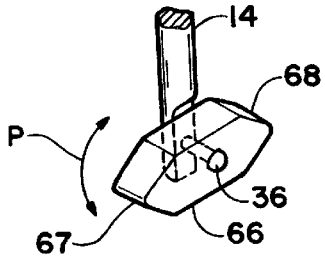
FIG. 7 is an isometric view of a portion of the carpet repair tool of FIG. 1 showing an embodiment thereof in which a wheel is replaced by an wedge shaped element.

In FIG. 7 there is shown a wedge shaped element 66 which functions in a manner similar to the ovoid element 61. The wedge shaped element 66 is movably fixed by the pin 36 to the leg 14 and the element includes generally pointed ends 67 and 68. In use, the element 66 moves, as indicated by the double arrow P, performing a function similar to that of the ovoid element 61 and the wheels 31 and 32.

From the foregoing it will be appreciated that the carpet repair tool provided by the invention provides an efficient technique for carpet repair. The tool is mechanically simple and convenient to use. It enables a user to deposit adhesive between separated carpet portions effectively, while reducing or eliminating a likelihood of soiling the carpet with adhesive.

It will be evident that there are additional embodiments and applications which are not disclosed in the detailed description but which clearly fall within the scope of the present invention. The specification is, therefore, intended not to be limiting, and the scope of the invention is to be limited only by the following claims.

What is claimed is:

1. A carpet seam repair tool for repairing a seam in installed carpet wherein a first carpet portion is separated from a second carpet portion along a seam rift and the seam overlies an adhesive tape, the repair tool comprising:

a pair of legs;

connecting means for joining each one of said pair of elongated legs for movement of said legs about said connecting means, wherein said connecting means is located adjacent an end of each one of said pair of legs;

means for holding said carpet away from said tape wherein said holding means includes a wheel mounted adjacent an end of one of said pair of legs at an end opposite said connecting means.

2. The carpet seam repair tool according to claim 1, wherein said connecting means is a pin.

3. The carpet seam repair tool according to claim 1, wherein each one of said pair of legs is generally cylindrical in circumference having a flattened portion at an end thereof.

4. The carpet seam repair tool according to claim 1, wherein each one of said pair of legs includes a medial side and a lateral side wherein a land is formed on the lateral side of each one of said pair of legs at an end opposite the location of said connecting means.

5. The carpet seam repair tool according to claim 1, wherein said means for holding includes a pair of wheels wherein one of said pair of wheels is attached, for rotational movement, to one leg, at an end thereof opposite the location of said connecting means, and another one of said pair of wheels is attached to the other one of said pair of legs, at an end thereof opposite the location of said connecting means.

6. The carpet seam repair tool according to claim 5, wherein each one of said wheels is attached at a land of a leg.

7. The carpet seam repair tool according to claim 6, including a pair of pins wherein each one of said pair of pins attaches a wheel for rotational movement thereabout.

8. The carpet seam repair tool according to claim 1, including a member fixed to one of said pair of legs for guiding each one of said pair of legs in coplanar movement toward and away from one another.

9. The carpet seam repair tool according to claim 8, wherein said member is fixed to one of said legs, said other leg having an opening therein formed, wherein said member extends through said opening.

10. The carpet seam repair tool according to claim 1, including means for fixing said legs in a selected spaced relationship to one another.

11. The carpet seam repair tool according to claim 10, wherein said means for fixing is a screw member.

12. A method of repairing a seam in installed carpet wherein a first carpet portion is separated from a second carpet portion along a seam rift wherein the seam overlies an adhesive tape, the steps comprising:

identifying a first location in said seam rift where said carpet first portion and said carpet second portion are separated;

identifying a second location in said seam rift, spaced from said first location, where said carpet first portion and said carpet second portion are separated;

providing a tool for insertion between said separated carpet portions and said adhesive tape, said tool having means for holding said first and second portions in separated relationship and a wheel for holding said separated portions away from said adhesive tape;

inserting said tool between said carpet portions and between said separated portions and said adhesive tape;

drawing said tool along said seam away from said first location and toward said second location; and applying adhesive to said adhesive tape between said first location and said second location, as said tool is being drawn toward said second location.

13. The method according to claim 12, wherein said providing step includes a step of providing a tool having legs connected at one end to a movable joint and said inserting step includes a step of fixing said legs in a spaced apart relationship to one another.

14. A carpet seam repair tool for repairing a seam in installed carpet wherein a first carpet portion is separated from a second carpet portion along a seam rift and the seam overlies an adhesive tape, the repair tool comprising:

a pair of legs;

connecting means for joining each one of said pair of legs for coplanar movement of said legs about said connecting means, wherein said connecting means is located adjacent an end of each one of said pair of legs;

an ovoid element for holding said carpet away from said tape wherein said ovoid element is mounted adjacent an end of each one of said pair of legs at an end opposite said connecting means.

* * * * *